US006524696B1

(12) United States Patent
Gumbiowski et al.

(10) Patent No.: US 6,524,696 B1
(45) **Date of Patent: *Feb. 25, 2003**

(54) SUPPORT FOR INK-JET RECORDING MATERIAL

(75) Inventors: Rainer Gumbiowski, Wallenhorst (DE); Wolfgang Storbeck, Freiberg (DE)

(73) Assignee: Felix Schoeller jr. Foto-und Spezialpapiere GmbH & Co. KG (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/344,147

(22) Filed: Jun. 24, 1999

(30) Foreign Application Priority Data

Jun. 26, 1998 (DE) ..... 198 28 532

(51) Int. Cl.[7] ..... B41M 5/00

(52) U.S. Cl. ..... 428/327; 428/195; 428/537.5

(58) Field of Search ..... 428/195, 211, 428/327, 330, 537.5

(56) References Cited

U.S. PATENT DOCUMENTS 5,576,088 A 11/1996 Ogawa et al.

FOREIGN PATENT DOCUMENTS

| | | |
|---|---|---|
| DE | 195 17 040 | 11/1996 |
| EP | 709 221 | 5/1996 |

*Primary Examiner*—Pamela R. Schwartz
(74) *Attorney, Agent, or Firm*—Cook, Alex, McFarron, Manzo, Cummings & Mehler, Ltd.

(57) ABSTRACT

A support for an ink-jet recording material comprising a base paper having a layer on at least one side of the base paper which includes barium sulfate and thermoplastic hollow microbeads.

14 Claims, No Drawings

SUPPORT FOR INK-JET RECORDING MATERIAL

BACKGROUND, SUMMARY AND DESCRIPTION OF THE INVENTION

This invention concerns a support for a recording material for the ink-jet printing process.

The ink-jet recording method is an electronic printing method which has already been described repeatedly. It is used in a broad field of applications for production of color graphics, color images and also for printing text. High demands are made of the recording materials used with this technology. These include, for example, a high ink density, high resolution, short ink drying times, light stability and dimensional stability. Surface gloss is another important demand for commercial applications. This is important especially in the production of art graphics. However, gloss is also an important requirement in production of images where a photographic quality is required.

EP 650 850 A discloses a recording material consisting of a polyolefin-coated base paper and a receiving layer. This recording material permits the production of images with a high resolution and ink density and a high gloss which are comparable in the overall impression to conventional photographic images. One disadvantage of the polyethylene-coated support is the poor uptake of ink fluid due to the fact that the paper is sealed with a plastic, which leads to poor drying behavior of the recording material. In addition, the limited recyclability of such a polyolefin-coated support material should not be forgotten.

EP 709 221 A proposes a recording material containing a paper substrate with a certain Sheffield water-soluble components, where the total recording material has a gloss of more than 50, measured at an angle of 60 °.

In a few other publications, glossy recording materials are claimed, where the receiving layer is pressed against a heated mirror-smooth cylinder surface in a cast-coating operation, so the recording material is given a high-gloss surface.

The object of this invention is to create a support for an ink-jet recording material suitable for any type of ink receiving layers on which especially glossy photographic quality images can be produced with conventional ink-jet inks. In addition, the object of this invention is to propose a recording material for ink-jet printing methods that can be produced with the help of the above-mentioned support.

These objects are achieved by a support for an ink-jet recording material containing a base paper having on at least one side a layer containing barium sulfate and microbeads.

Hollow polymer microbeads of a thermnoplastically deformable plastic based on polystyrene-acrylate and styrene or acrylic resin are especially suitable. The microbeads have a diameter of at least 0.2 $\mu$m. Microbeads with a diameter of 0.4 $\mu$m to 5 $\mu$m are especially suitable.

The microbead content in the layer containing barium sulfate may be 1 to 70 wt %, based on the layer. Especially good results were obtained with a microbead content of 20 to 50 wt %.

The binder used in the above-mentioned layer may be selected from the group of hydrophilic colloidal and/or water-soluble binders such as polyvinyl alcohol, polyvinylpyrrolidone, polyacrylamide, gelatin, starch, starch derivatives, polyvinyl acetate, polyethylene glycol, cellulose esters, proteins, alginates, polyacrylic acid or mixtures of these binders.

The coating weight of the layer is 10 to 50 g/m$^2$, in particular 15 to 25 g/m$^2$. The base paper has a raw paper core which is produced preferably by using chemical pulp or pulp mixtures with a short fiber content of 80 to 98 wt %, in particular 85 to 95 wt % (unbeaten pulp).

Hardwood pulp mixtures with a fiber length of 0.50 to 0.60 mm (unbeaten pulp) or 0.40 to 0.50 mm (with a degree of beating between 25 and 35° SR) are especially suitable. The pulp mixture according to this invention has in particular a degree of beating of 28 to 32° SR (measured according to Schopper-Riegler).

The raw paper may also contain other substances such as a sizing agent and fillers. In principle, all conventional compounds for paper making can be used as sizing agents and wet strength agents. In a special embodiment of this invention, the raw paper contains kaolin and calcium carbonate in a ratio of 2:1 to 1:2 and has a Cobb value of 20 to 100. The raw paper may also be surface-sized with starch, gelatin or polyvinyl alcohol. The basis weight of the raw paper is 60 to 220 g/m$^2$, in particular 80 to 160 g/m$^2$.

It has been found that by using the pulp mixture which is specified in detail and by using the filler with a simultaneous reduction in the amount of sizing agent, it is possible to produce a base paper with which a recording material with very good dimensional stability (curl and cockle behavior) and good uptake of the ink fluid can be obtained.

The support according to this invention may also contain additional function layers, e.g., adhesive layers, antistatic layers or non-curl layers, on at least one side.

The support according to this invention is then subjected to a satinizing operation in a known manner. Any desired ink receiving layer for ink-jet printing processes may be applied to the front side of the support. The ink receiving layer may be at least one hydrophilic layer which is suitable for receiving most aqueous inks. An ink receiving layer usually contains a hydrophilic or water-soluble binder, cationic pigment-fixing compounds, pigments and optionally other additives. The coating weight of the ink receiving layer is 5 to 20 g/m$^2$.

The present invention will now be illustrated in greater detail on the basis of the following examples.

EXAMPLES 1 to 3

A mixture of 100 wt % hardwood sulfate pulp mixture with an average short fiber content of 93% (unbeaten) was beaten to a degree of beating of 32° SR at a pulp density of 4.5%. Then the following substances according to Table 1 were added to the pulp suspension, and raw papers with a weight of approximately 150 g/m$^2$ were prepared in a known way from the suspensions diluted to approximately 1.2 wt %.

TABLE 1

| Additives and quantities* according to Examples 1 to 3 | 1 | 2 | 3 |
|---|---|---|---|
| Calcined kaolin | 8.00 | 12.00 | 8.00 |
| $CaCO_3$ | 10.00 | 6.00 | 12.00 |
| Alkylketene dimer | 0.10 | 0.15 | 0.20 |
| Polyamide/polyamine-epichlorohydrin resin | 0.50 | 0.50 | 0.50 |

*All quantities in this table are percentage by weight (wt %) and are based on the weight of the fiber pulp The front side of the raw papers according to Examples 1 through 3 was then coated with an aqueous coating compound containing barite, then dried and the coated paper was then satinized. The resulting layers had the following composition:

TABLE 2

| | Examples | | | | | | | | |
|---|---|---|---|---|---|---|---|---|---|
| | 1.1 | 1.2 | 1.3 | 1.4 | 2.1 | 2.2 | 2.3 | 3.1 | 3.2 |
| Barium sulfate | 59.2 | 37.00 | 25.00 | 10.00 | 55.00 | 25.00 | 74.00 | 40.00 | 25.00 |
| Microbeads* | 14.80 | 37.00 | 50.00 | 65.00 | 20.00 | 50.00 | 1.00 | 20.00 | 50.00 |
| Gelatin | 25.56 | 25.73 | 24.73 | — | 24.73 | — | 24.73 | 39.63 | — |
| PVA | — | — | — | 24.93 | — | 24.93 | — | — | 24.93 |
| Chromic alum | 0.20 | 0.20 | 0.20 | — | 0.20 | — | 0.20 | 0.30 | — |
| Citric acid | 0.07 | 0.07 | 0.07 | 0.07 | 0.07 | 0.07 | 0.07 | 0.07 | 0.07 |
| Coating weight, g/m$^2$ | 10 | 15 | 15 | 15 | 15 | 20 | 25 | 25 | 15 |

*hollow microbeads of styrene-acrylate copolymer with a diameter of approximately 0.4 $\mu$m

EXAMPLES 4 and 5

A mixture of 100 wt % hardwood sulfate pulp with an average short fiber content of 90% (unbeaten) was beaten to a degree of beating of 28° SR at a pulp density of 4.5%. The following substances according to Table 3 were then added to the pulp suspension, and raw papers with a weight of approximately 150 g/m$^2$ were prepared as in Examples 1 to 3.

TABLE 3

| Additives and quantities* according to Examples 4 and 5 | 4 | 5 |
|---|---|---|
| Calcined kaolin | 8.00 | 12.00 |
| $CaCO_3$ | 10.00 | 6.00 |
| Alkylketene dimer | 0.10 | 0.10 |
| Polyamide/polyamine-epichlorohydrin resin | 0.50 | 0.50 |

*)All quantities in this table are percentage by weight (wt %) and are based on the weight of the pulp The front side of the raw papers according to Examples 4 and 5 was coated with an aqueous coating composition containing barite and dried, and then the coated paper was satinized. The resulting layers had the following composition:

TABLE 4

| | Examples | | | |
|---|---|---|---|---|
| | 4.1 | 4.2 | 5.1 | 5.2 |
| Barium sulfate | 50.00 | 25.00 | 65.00 | 15.00 |
| Microbeads* | 20.00 | 50.00 | 10.00 | 60.00 |
| Gelatin | 29.70 | — | 24.73 | — |
| Polyvinyl alcohol | — | 24.93 | — | 24.93 |
| Chromic alum | 0.23 | — | 0.20 | — |
| Citric acid | 0.07 | 0.07 | 0.07 | 0.07 |
| Coating weight, g/m$^2$ | 15 | 25 | 15 | 35 |

*hollow microbeads of styrene-acrylate copolymer with a diameter of approximately 1 $\mu$m

Comparative Examples 1 to 3

A mixture of 80 wt % hardwood sulfate pulp mixture and 20 wt % softwood sulfate pulp with an average short fiber content of 88.6% was beaten to a degree of beating of 29° SR at a pulp density of 4.5%. Then the following substances according to Table 5 were added to the pulp suspension, and raw papers with a weight of approximately 150 g/m$^2$ were prepared in the known way from the suspensions diluted to approximately 1.2 wt %.

TABLE 5

| Additives and quantities* according to Comparative Examples V1 to V3 | V1 | V2 | V3 |
|---|---|---|---|
| Calcined kaolin | 8.00 | — | — |
| $CaCO_3$ | 10.00 | 10.00 | — |
| $Na_2CO_3$ | — | — | 0.50 |
| Alkylketene dimer | 0.10 | 0.50 | 0.50 |
| Polyamide/polyamine-epichlorohydrin resin | 0.50 | 0.50 | 1.00 |

*All quantities in this table are wt % based on the weight of the pulp

The raw papers according to Comparative Examples V1 through V3 were coated on the front side with a coating composition containing barite, then dried, and next the coated paper was satinized. The baryta layer consists of 74 wt % barium sulfate and 26 wt % gelatin.

Comparative Example 4

The pulp mixture of 70 wt % hardwood sulfate pulp and 30 wt % softwood sulfate pulp was beaten to a degree of beating of 37° SR at a pulp density of 4.5%. Then the following substances according to Comparative Example V3 were added to the pulp suspension, and raw paper with a weight of approximately 150 g/m$^2$ was prepared in the known way from suspensions diluted to approximately 1.2 wt %. Then the front side of this raw paper was provided with a barite layer as in Comparative Examples V1–V3.

In the next step, the papers coated according to this invention were coated with an ink receiving layer. Any receiving layer for ink-jet printing processes can be used for this. The ink receiving layer used in the present case for test purposes had the following composition:

| | wt % |
|---|---|
| Polyvinyl alcohol | 31.6% |
| Polyvinylpyrrolidone | 31.6% |
| Vinyl acetate-butyl acrylate copolymer | 31.6% |
| Polydiallyldimethylammonium chloride | 5.2% |

The coating weight of the ink receiving layer was 10 g/m$^2$. The papers according to this invention provided with the ink receiving layer were printed with the help of a so-called thermal jet method and then analyzed. The test results are summarized in Table 6.

Testing the Papers Produced According to the Examples and Comparative Examples

The recording material consisting of the papers according to this invention and the ink receiving layer was printed with the help of a HP DeskJet 550 C ink-jet printer from Hewlett Packard, which operates by the bubble jet principle (thermal jet).

The gloss, drying time, bleed-through of ink to the back side of the paper, the curl and so-called cockle (waviness) of the resulting test print images were tested, with the last two properties being combined as dimensional stability.

The gloss values were measured according to DIN 67,530 at a measurement angle of 60° using an RL3 laboratory reflectometer from Dr. Lange's company.

The drying properties of the recording material were evaluated as follows:

A bar was printed in black ink (pure black) on a sheet of paper, and after a waiting time of two minutes, paper (20 sheets) was placed on it. The ink transfer to the paper on top is used as a measure of drying. The drying time is evaluated for the ranges <2 minutes (very good), 2–7 minutes (moderate) and >7 minutes (poor).

The ink bleed-through method is evaluated by the intensity of the discoloration due to ink showing through to the back side of the paper. Grades of 1 to 12 (very good to very bad) are given here.

To determine the dimensional stability, the paper to be tested is placed on a substrate. The flatness of the paper is evaluated with a grade of 1 to 12 (very good to very bad).

Other properties such as ink density, waterfastness or bleed which were also tested and found to be very good will not be discussed in detail here.

TABLE 6

Test results

| Example | Gloss | Drying time min | Dimensional stability | Ink bleed-through |
|---|---|---|---|---|
| 1.1 | 57 | 6.5 | 2 | 2 |
| 1.2 | 62 | 7.0 | 2 | 2 |
| 1.3 | 67 | 7.5 | 2 | 3 |
| 1.4 | 65 | 5.3 | 2 | 3 |
| 2.1 | 53 | 7.5 | 1 | 1 |
| 2.2 | 66 | 6.0 | 1 | 2 |
| 2.3 | 43 | 7.8 | 1 | 1 |
| 3.1 | 50 | 6.9 | 1 | 1 |
| 3.2 | 65 | 6.3 | 1 | 2 |
| V1 | 45 | 8.0 | 6 | 4 |
| V2 | 42 | 8.7 | 7 | 5 |
| V3 | 44 | 9.0 | 7 | 5 |

As shown by this table, the base papers according to this invention have in particular a much higher gloss and a better dimensional stability in comparison with the comparative papers. However, papers should always be evaluated in the totality of their properties.

What we claim is:

1. A support for an ink-jet recording material comprising a base paper having a layer directly on at least one side of the base paper which includes a binder, barium sulfate and about 1 to 70 wt % thermoplastic hollow microbeads based upon the weight of the layer, said microbeads having a diameter of at least 0.2 $\mu$m.

2. A support according to claim 1, wherein the content of microbeads in the layer is at least 1 wt %, based on the weight of the dry layer.

3. A support according to claim 1, wherein the content of microbeads in the layer is 20 to 50 wt %, based on the weight of the dry layer.

4. A support according to claim 1, wherein the layer includes a hydrophilic colloidal and/or water-soluble binder.

5. A support according to claim 1, wherein the paper contains a chemical pulp mixture with a content of short fibers of 80 to 98 weight percent.

6. A support according to claim 1, wherein the paper contains kaolin and calcium carbonate in a weight ratio of 2:1 to 1:2.

7. A support according to claim 1, wherein the base paper has a degree of sizing with a Cobb value of 20 to 100.

8. A support according to claim 1, wherein said layer has a coating weight of 10 to 50 g/m$^2$.

9. A support according to claim 1, wherein said base paper has a basis weight of 60 to 220 g/ml$^1$.

10. A support according to claim 1, wherein said layer has a coating weight of 10 to 50 g/m$^2$, and said base paper has a basis weight of 60 to 220 g/m$^2$.

11. A recording material for the ink-jet printing process having a support and an ink-receiving layer arranged on the support wherein the support comprises base paper having directly on at least one side of the base paper a layer which includes a binder, barium sulfate and about 1 to 70 wt % thermoplastic hollow microbeads based upon the weight of the layer, said microbeads having a diameter of at least 0.2 $\mu$m.

12. A recording material according to claim 11, wherein said layer has a coating weight of 10 to 50 g/m$^2$.

13. A recording material according to claim 11, wherein said base paper has a basis weight of 60 to 220 g/m$^2$.

14. A recording material according to claim 11, wherein said layer has a coating weight of 10 to 50 g/m$^2$, and said base paper has a basis weight of 60 to 220 g/m$^2$.

* * * * *